United States Patent [19]

Folk et al.

[11] 3,936,933

[45] Feb. 10, 1976

[54] METHOD FOR POSITIONING LEADING PORTIONS OF INDIVIDUAL WIRES OF A PLURALITY OF WIRES IN SPACED APART RELATIONSHIPS WITH RESPECT TO EACH OTHER AND A TEMPLATE UTILIZED IN ACCOMPLISHING THE SAME

[75] Inventors: Kenneth Foster Folk; Milton Dean Ross; Walter Clifton Shatto, Jr., all of Harrisburg, Pa.

[73] Assignee: AMP Incorporated, Harrisburg, Pa.

[22] Filed: Apr. 2, 1975

[21] Appl. No.: 564,523

Related U.S. Application Data

[62] Division of Ser. No. 389,924, Aug. 20, 1973, Pat. No. 3,891,013.

[52] U.S. Cl. ..... 29/628; 29/203 D; 29/203 P; 29/630 A; 140/147

[51] Int. Cl.[2] ..... H01R 43/00

[58] Field of Search ..... 29/203 D, 203 DT, 203 DS, 29/203 P, 203 J, 628, 629, 630 B; 140/105, 147

[56] References Cited

UNITED STATES PATENTS

| | | | |
|---|---|---|---|
| 3,195,584 | 7/1965 | Zimmerman et al. | 140/147 |
| 3,283,987 | 11/1966 | Kauffman | 29/630 B |
| 3,450,829 | 6/1969 | Paul | 29/628 |
| 3,687,172 | 8/1972 | Suverkropp | 53/21 R |
| 3,707,756 | 1/1973 | Wolyn | 29/203 D |
| 3,708,853 | 1/1973 | Humen et al. | 29/203 D |
| 3,747,186 | 7/1973 | Cervenka et al. | 29/203 D |
| 3,765,073 | 10/1973 | Burns | 29/203 D |
| 3,881,246 | 5/1975 | Folk | 29/628 |

FOREIGN PATENTS OR APPLICATIONS

| | | | |
|---|---|---|---|
| 1,078,548 | 8/1967 | United Kingdom | 140/147 |

OTHER PUBLICATIONS

IBM Technical Disclosure Bulletin, Vol. 4, pp. 28–29.

*Primary Examiner*—C. W. Lanham
*Assistant Examiner*—E. M. Combs
*Attorney, Agent, or Firm*—AMP Incorporated

[57] ABSTRACT

Leading portions of individual wires of a plurality of wires are positioned in spaced apart relationships with respect to each other by a wire separating mechanism which utilizes a template having a generally planar surface with a primary groove defined therein capable of substantially accommodating a trailing portion of each of the wires in a bunched together condition and a plurality of secondary grooves defined therein which emanate from the primary groove along separate, spaced apart paths, each of the secondary grooves capable of substantially accommodating therein the leading portion of only one of the wires. A clamp on the mechanism located near one end of the primary groove holds the trailing portions of the wires within the primary groove in their bunched together condition. A roller element mounted on the mechanism and having a cylindrical surface is moved by the mechanism into engagement with the trailing portions of the wires so as to introduce compressive forces thereon. Alternatively, a slide element may be utilized in place of the roller element. The mechanism continues the application of the compressive forces simultaneously along the wires by rolling the roller element along the planar surface of the template such that the application of the compressive forces simultaneously progresses along each of the wires from the trailing portion toward the leading portion of each of the wires whereby the leading portions of the wires are forced individually into respective secondary grooves in the planar surface of the template and thereby positioned in spaced apart relationships with respect to each other.

11 Claims, 29 Drawing Figures

Fig 3
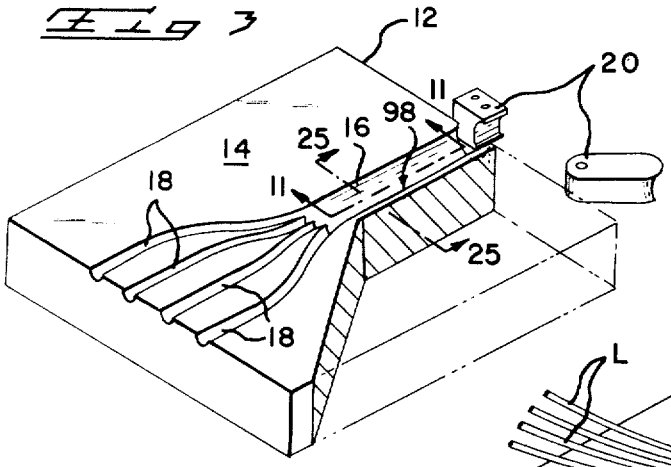
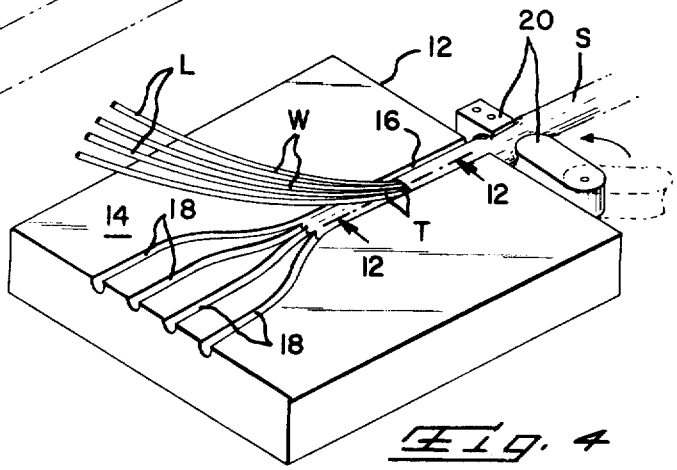
Fig. 4
Fig. 5A
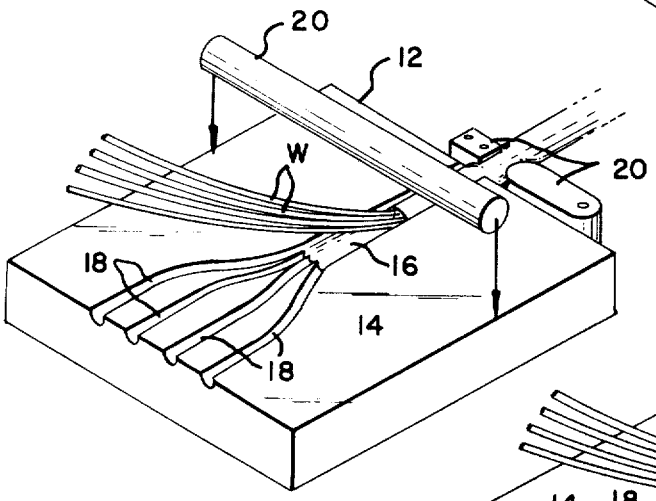
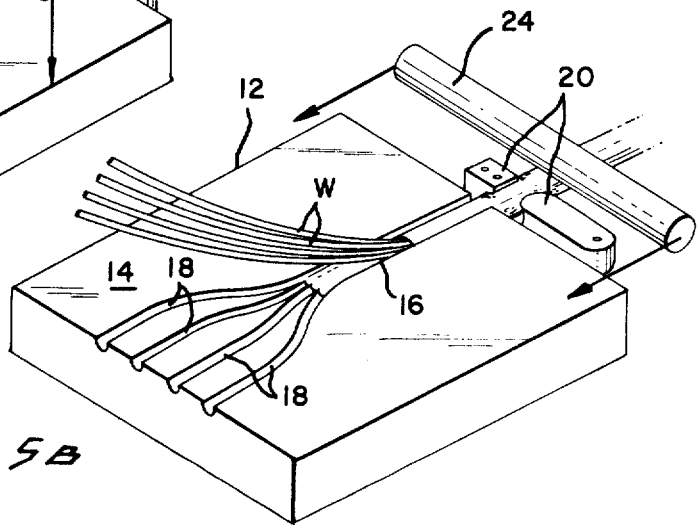
Fig. 5B

Fig. 9
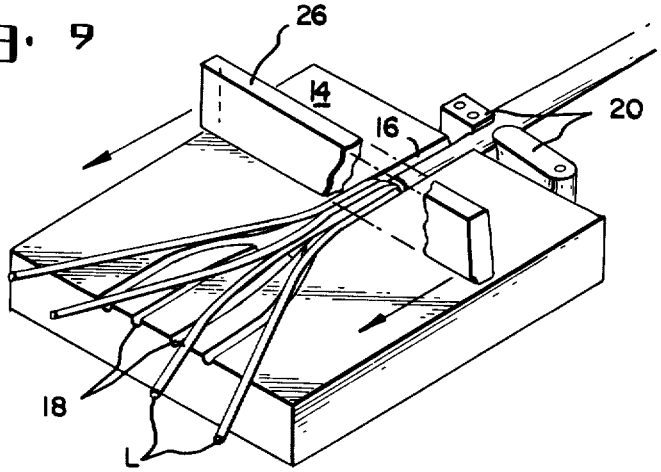
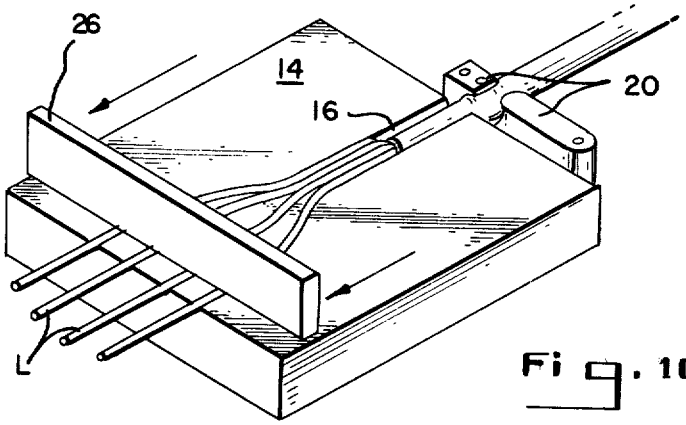
Fig. 10

Fig. 15
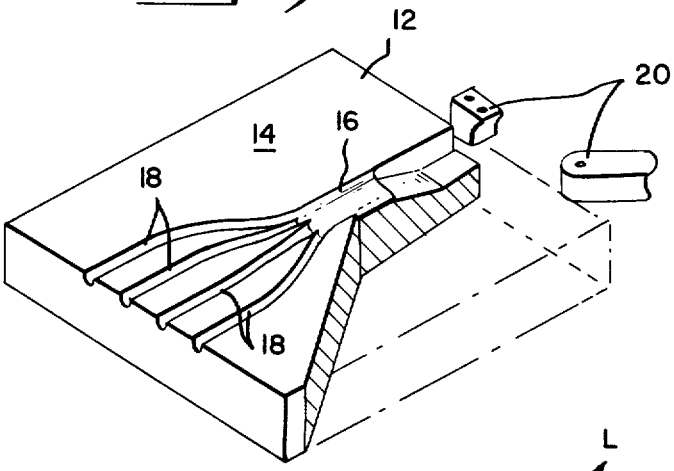
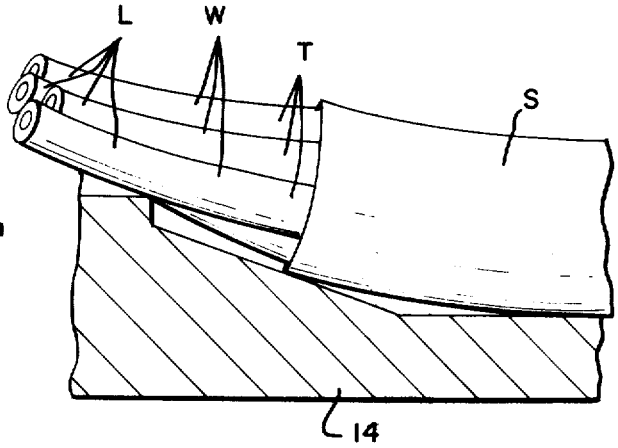
Fig. 16
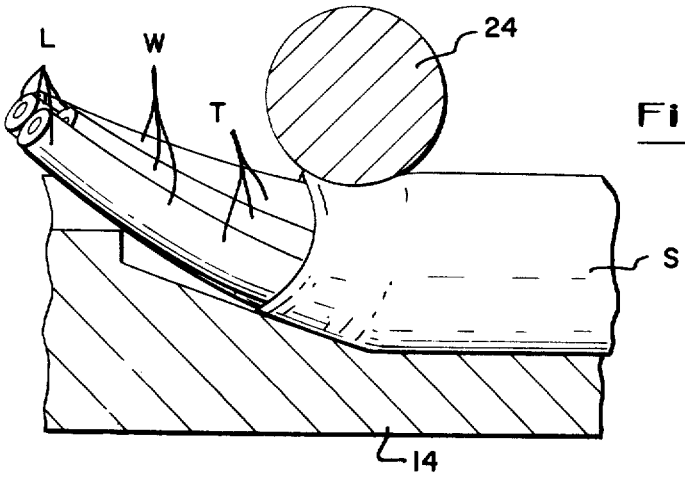
Fig. 17

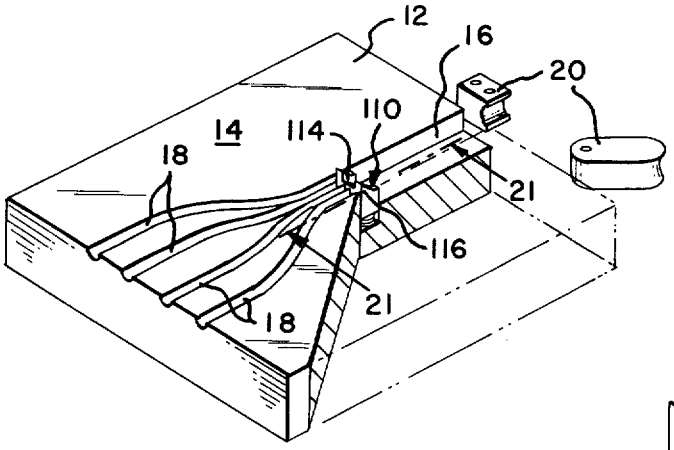
Fig. 20
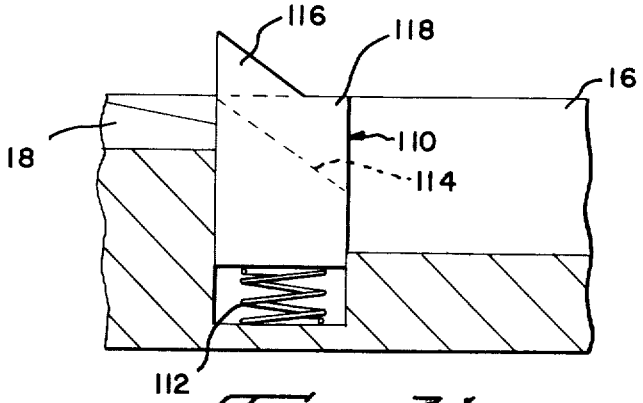
Fig. 21
Fig. 22
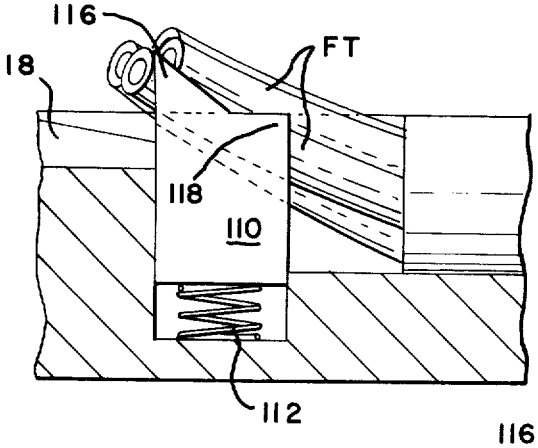
Fig. 23
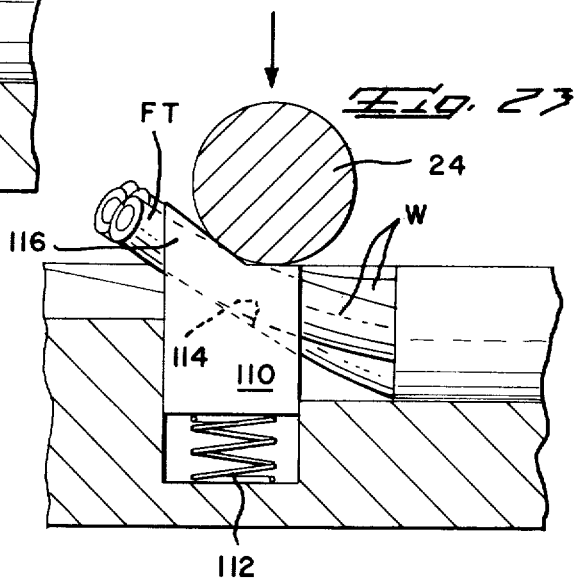
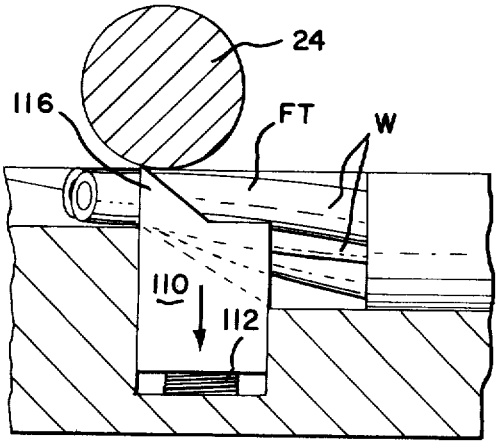
Fig. 24

Fig. 25
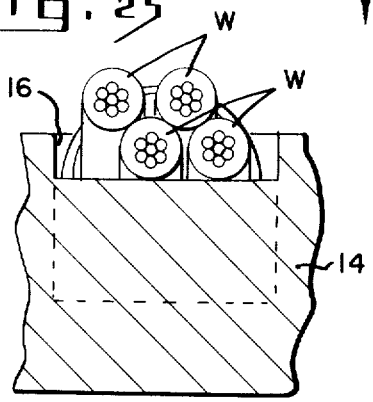
Fig. 26
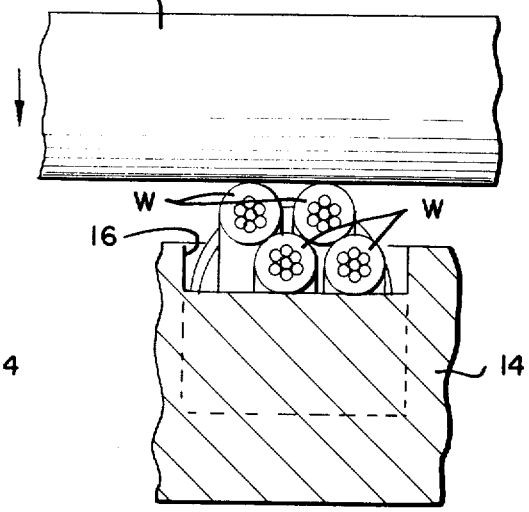
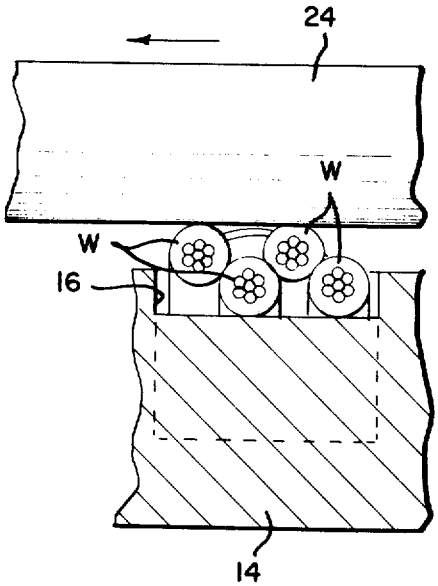
Fig. 27
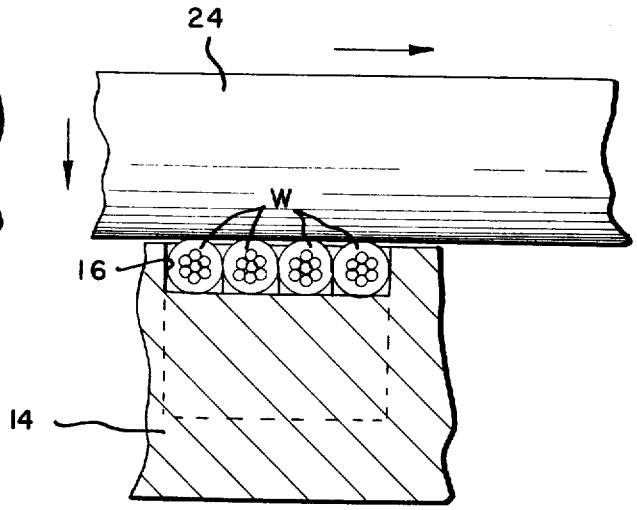
Fig. 28

METHOD FOR POSITIONING LEADING PORTIONS OF INDIVIDUAL WIRES OF A PLURALITY OF WIRES IN SPACED APART RELATIONSHIPS WITH RESPECT TO EACH OTHER AND A TEMPLATE UTILIZED IN ACCOMPLISHING THE SAME

This is a division, of application Ser. No. 389,924 filed Aug. 20, 1973, now U.S. Pat. No. 3,891,013.

BACKGROUND OF THE INVENTION

1. Field of the Invention

The present invention relates generally to the assembly of electrical connecting devices to individual conductor wires of a plurality of wires and more particularly is concerned with a method and apparatus for positioning leading portions of the individual wires in spaced apart relationships with respect to each other to allow simultaneous assembly of the connecting devices to the individual wires.

2. Description of the Prior Art

Heretofore, the assembly of electrical connecting devices, such as terminals, etc., to individual conductor wires of a plurality of wires, for example, wires bunched together and enclosed by an insulation sheath, has been predominately carried out by inherently expensive and slow hand operations which include separating one at a time the portions of individual wires which freely extend from the bunched together plurality of wires and positioning these wire portions one at a time into appropriate applicator tools for assembly of the connecting device thereto.

The present invention eliminates the inherent limitations of the aforementioned hand operations by providing automated separating and positioning of these individual wire portions in spaced apart relationships with respect to each other to allow simultaneous assembly of the connecting devices thereto.

OBJECTS AND SUMMARY OF THE INVENTION

An object of the present invention, therefore, is to provide a method and apparatus which significantly automates the assembly of electrical connecting devices to pluralities of conductor wires.

Another object of the present invention, accordingly, is to provide a method and apparatus which simultaneously separates and positions the leading portions of the wires into spaced apart relationships and thereby allows for the simultaneous occurrence of subsequent operations which result in the assembly of the connecting devices to the wires.

These and other objects of the invention are achieved in a preferred embodiment thereof wherein method and apparatus achieve positioning of leading portions of individual wires of a plurality of wires in spaced apart relationships with respect to each other. First and second surface means are provided with the first surface means having a primary groove defined therein capable of substantially accommodating a trailing portion of each of the wires in a bunched together condition and a plurality of secondary grooves defined therein which emanate from the primary groove along separate, spaced apart paths, each of the secondary grooves capable of substantially accommodating therein the leading portion of only one of the wires. Holding means positions the trailing portions of the wires in their bunched together condition in the primary groove of the first surface means. Force-applying means introduces an application of compressive forces on the wires at their trailing portions by bringing the second surface means and the primary groove of the first surface means into close proximity to each other while the trailing portions are so positioned in the primary groove of the first surface means by the holding means. The force-applying means then continues the application of compressive forces simultaneously along the wires by moving at least one of the first surface means and the second surface means relative to the other such that the application of the compressive forces simultaneously progresses along each of the wires from its trailing portion toward its leading portion whereby the leading portions of the wires are forced individually into respective secondary grooves of the first surface means and thereby positioned in spaced apart relationships with respect to each other.

Other objects and attainments of the invention will become apparent to those skilled in the art upon a reading of the following detailed description when taken in conjunction with the drawings in which there is shown and described illustrative embodiments of the invention; it is to be understood, however, that these embodiments are not intended to be exhaustive nor limiting of the invention but are given for purpose of illustration in order that others skilled in the art may fully understand the invention and the principles thereof and the manner of applying it in practical use so that they may modify it in various forms, each as may be best suited to the condition of a particular use.

BRIEF DESCRIPTION OF THE DRAWINGS

In the course of the following detailed description reference will be frequently made to the attached drawings in which:

FIG. 3 is an enlarged perspective view of one form of the template utilized in the apparatus of FIG. 1 also showing a clamp positioned next to an end of the primary groove in the top surface of the template;

FIG. 4 is a perspective view similar to that of FIG. 3 now showing a plurality of wires emanating from an insulation sheath and being positioned in the primary groove by the clamp;

FIG. 5A is a perspective view similar to that of FIG. 4 now showing a roller element of the mechanism of FIG. 1 in an initial position aligned above trailing portions of the wires;

FIG. 5B is a perspective view similar to that of FIG. 5A but showing the roller element in an alternative initial position aligned slightly above the top surface of the template and rearwardly of the trailing portions of the wires;

FIG. 9 is a perspective view similar to that of FIG. 7 but showing a slide element which may be utilized, in place of the roller element, in the apparatus of FIG. 1 to carry out substantially the same operations as the roller element;

FIG. 10 is a perspective view similar to that of FIG. 9 now showing the slide element after it has forced the leading portions of the wires into respective secondary grooves in the top surface of the template;

FIG. 15 is an enlarged perspective view similar to that of FIG. 3 showing an alternate form of the template in that the primary groove thereof now has a ramp and smaller step formed therein instead of the larger step as shown in FIGS. 3 and 11;

FIG. 16 is an enlarged fragmentary sectional view similar to that of FIG. 12 but showing the alternative form of the template of FIG. 15;

FIG. 17 is an enlarged fragmentary sectional view similar to that of FIG. 13 but showing the alternative form of the template of FIG. 15 and showing the roller element engaging and applying compressive forces to the forward end of the insulation sheath to effect initial flattening of the sheath and spreading of the wires enclosed therein on the ramp of the primary groove;

FIG. 20 is an enlarged perspective view similar to that of FIGS. 3 and 15 showing yet another alternative form of the template in that a depressable plunger element is mounted into the primary groove thereof adjacent to its juncture with the plurality of secondary grooves of the template;

FIG. 21 is an enlarged fragmentary sectional view of the plunger element mounted at the juncture between between the primary groove and the plurality of secondary grooves taken along line 21—21 of FIG. 20 showing the plunger element in its normal rest position;

FIG. 22 is an enlarged fragmentary sectional view similar to that of FIG. 21 now showing the trailing portions of the wires positioned in the primary groove and extending upwardly and forwardly through a wire-confining notch defined in the upper end of the plunger element;

FIG. 23 is an enlarged fragmentary sectional view similar to that of FIG. 23 now showing the roller element engaging and applying compressive forces to the trailing portions of the wires to cause spreading and arrangement of the trailing portions into side-by-side dispositions within the wire-confining notch of the plunger element;

FIG. 24 is an enlarged fragmentary sectional view similar to that of FIG. 23 now showing the roller element after it has forceably moved the plunger element downwardly into the forward end of the primary groove to its depressed position which has caused the leading portions of the wires which extend in a forwardly direction from the wire-confining notch of the plunger element to be deposited individually into respective rearward ends of the secondary grooves;

FIG. 25 is another enlarged fragmentary sectional view of the primary groove of the template of FIG. 3 taken along line 25—25 of FIG. 4; and FIGS. 26 through 28 are enlarged fragmentary views similar to that of FIG. 25 further showing reciprocatory movement of the roller element, shown in enlarged fragmentary form, in a transverse relationship to the longitudinal extent of the trailing portions of the wires and the primary groove simultaneously as the roller element is engaging and applying compressive forces to the trailing portions of the wires.

DETAILED DESCRIPTION OF THE INVENTION

Figure 1:
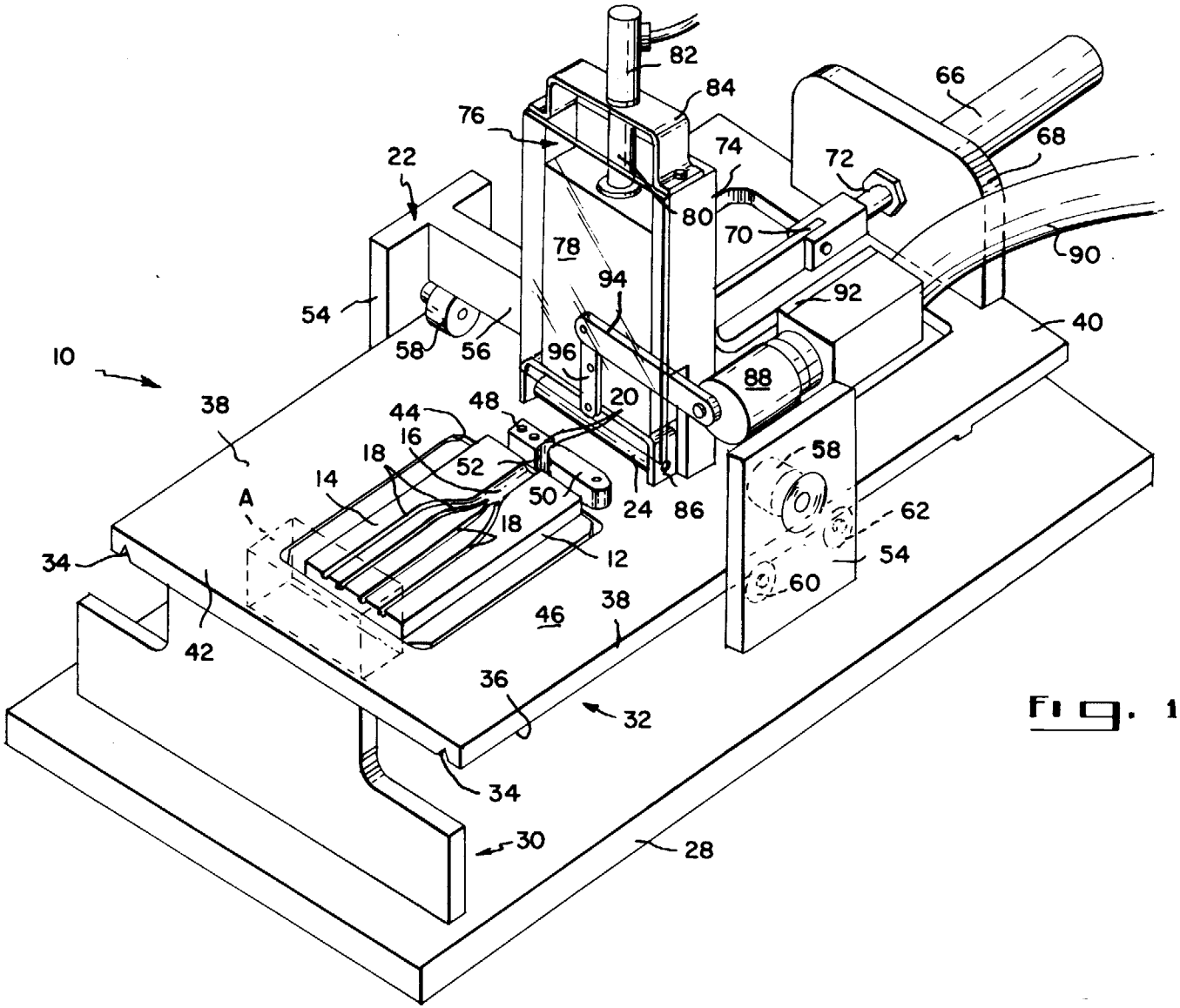
FIG. 1 is a perspective view of a wire separating mechanism comprising the apparatus of the present invention.
Figure 2:
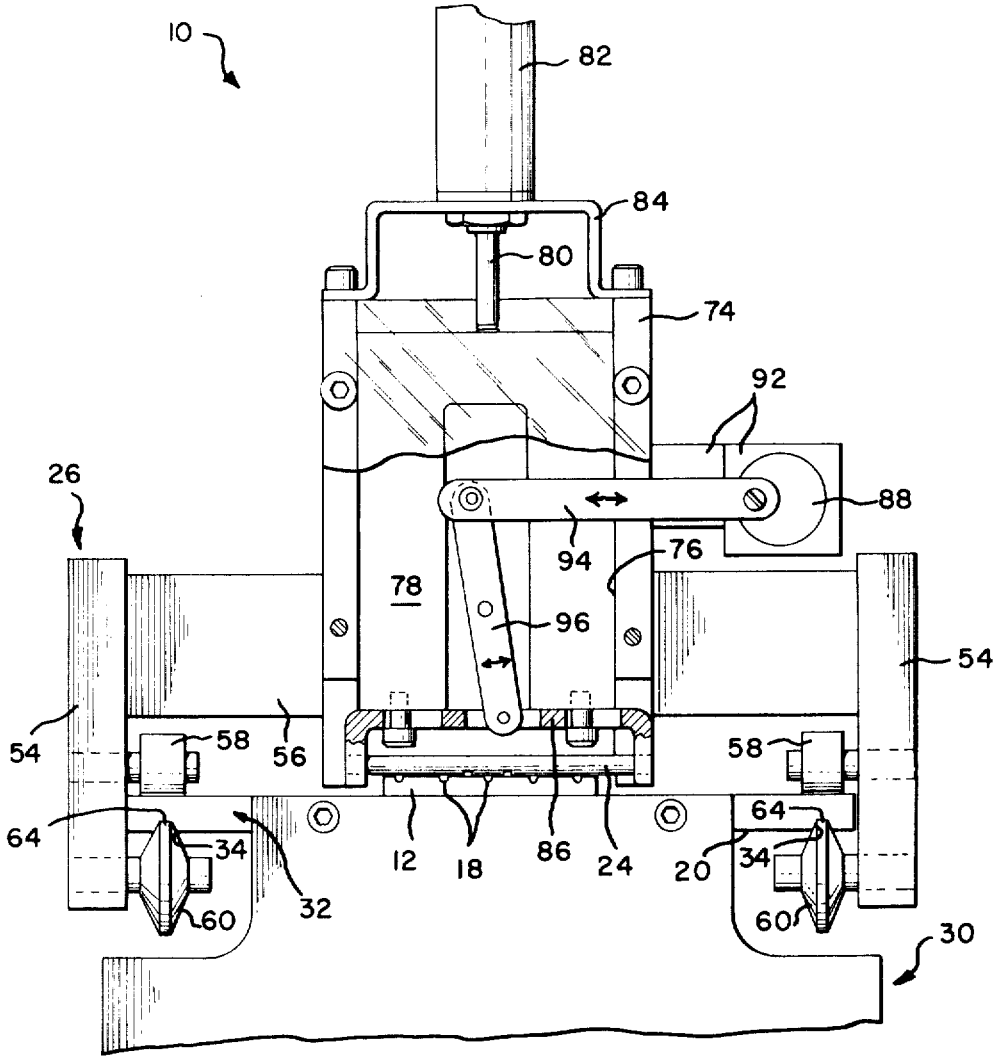
FIG. 2 is an enlarged front elevational view of the wire separating mechanism of FIG. 1.
Figure 6:
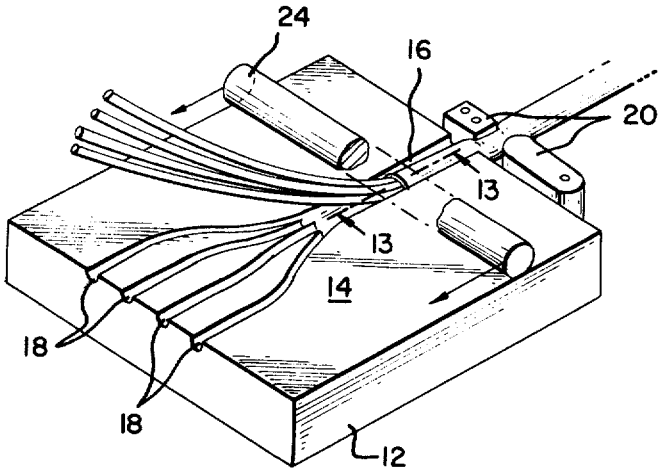
FIG. 6 is a perspective view similar to that of either FIG. 5A or FIG. 5B showing the roller element having been moved from either of the respective initial positions thereof into engagement with the trailing portions of the wires so as to apply compressive forces to the wires.
Figure 7:
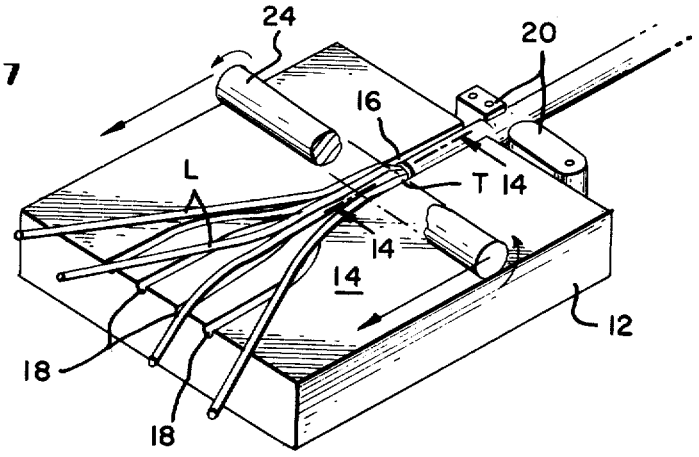
FIG. 7 is a perspective view similar to that of FIG. 6 now showing the roller element continuing to apply compressive forces on the wires while being rolled along the top surface of the template from the trailing portions toward the leading portions of the wires.

As a preferred or exemplary embodiment of the method and apparatus of the present invention, FIGS. 1 and 2 illustrate a wire separating mechanism 10 and FIGS. 3 through 8 schematically illustrate the basic sequence of operations performed by the mechanism 10 for positioning leading portions L of individual wires W of a plurality of wires W in spaced apart relationships with respect to each other.

Figure 8:
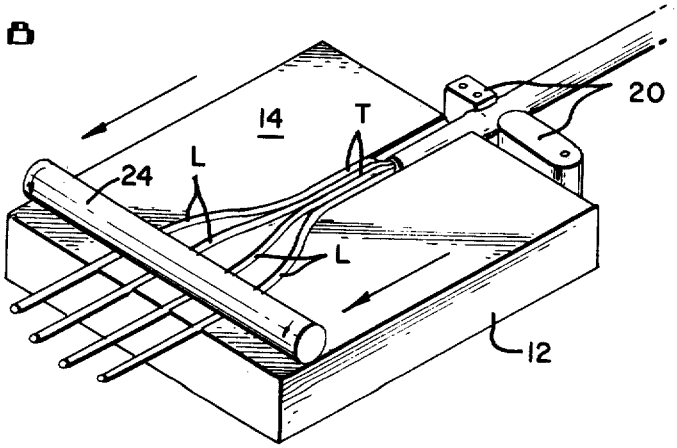
FIG. 8 is a perspective view similar to that of FIG. 7 now showing the roller element after having forced the leading portions of the wires into respective secondary grooves in the top surface of the template.
Figure 11:
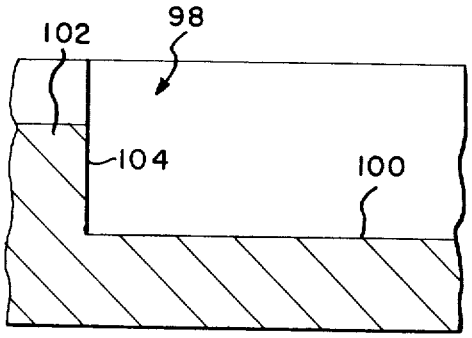
FIG. 11 is an enlarged fragmentary sectional view of the primary groove of the template taken along line 11—11 of FIG. 3 showing a step formed in the primary groove.

The wire separating mechanism 10 utilizes a novel template 12 having a generally planar upper surface 14 with a primary groove 16 defined therein capable of substantially accommodating a trailing portion T of each of the wires W in a bunched together condition (see FIG. 4) and a plurality of secondary grooves 18 defined therein which emanate from the primary groove 16 along separate, spaced apart paths and are each capable of substantially accommodating therein the leading portion L of only one of the wires W (see FIG. 8). After a plurality of wires W are manually located in the primary groove 16 of the template 12, a clamp 20 on the mechanism 10 located near one end of the primary groove 16 holds the trailing portions T of the wires W within the primary groove 16 in their bunched together condition (see FIG. 4). Although the wires W at the rearward ends of their trailing portions T, as illustrated in the drawings, are enclosed by an insulation sheath S, the trailing portions T may just as readily be held in the primary groove 16 by the clamp 20 without the assistance of the insulation sheath S. Positioning of the leading portions L of the wires W is achieved when a carriage 22 of the mechanism 10 moves a roller element 24 rotatably mounted thereon across the template 12 into engagement with the trailing portions T of the wires W so as to introduce compressive forces on the trailing portions T. Alternatively, a slide element 26, as shown in FIGS. 9 and 10, may be utilized in place of the roller element 24. Continued movement of the carriage 22 across the template 12 causes continuation of the application of compressive forces simultaneously along incremental lengths of the wires W by the roller element 24 such that the application of the compressive forces simultaneously progresses along each of the wires W from the trailing portion T toward the leading portion L of each of the wires W such that the leading portions L are forced individually into respective secondary grooves 18 in the planar surface 14 of the template 12 and thereby positioned in spaced apart relationships with respect to each other. The wires W have a predetermined length greater than that of the template 12 so that the free ends of the leading portions L will extend beyond the forward ends of the secondary grooves 18 of the template 12 (see FIG. 8) and be appropriately aligned for a suitable applicator mechanism A, such as a crimping press (shown in block outline form in FIG. 1), to simultaneously apply articles, such as electrical connecting devices, to the free ends of the wires W.

Referring now in greater detail to FIGS. 1 and 2, the wire separating mechanism 10 has a base 28 on which is securely mounted a table-like frame 30 having a generally horizontal top plate 32 with a tracking groove 34 defined in its underside 36 along each of its two opposing longitudinal edges 38 from its rearward end 40 to its forward end 42. A recessed region 44 is formed in an upperside 46 of the top plate 32 for snugly receiving and holding the template 12 therein. The clamp 20 has a unmovable part 48 securely fixed to the upperside 46 of the top plate 32, and a pivotal part 50 coupled to the plate 32, adjacent to one side of the recessed region 44 which is located near the rearward end of the primary groove 16 when the template 12 is positioned into the recessed region 44. The adjacent ends of the clamp parts 48, 50 define a wire-confining channel 52 for securely holding the wires W in their desired bunched together condition. It is readily apparent that rotation of the pivotal clamp part 50 either toward or away from the unmovable clamp part 48 allows for either securing or releasing the hold of the clamp 20 on the plurality of wires W as desired.

The carriage 22 is mounted on the top plate 32 of the frame 30 and includes a pair of opposing leg members 54 being separated from each other through a distance slightly greater than the width of the top plate 32 and a body member 56 which connects with the leg members 54 at their upper ends.

More particularly, the carriage 22 is mounted on the horizontal top plate 32 for movement therealong by a cylindrical roller 58 which is journalled to each of the leg members 54 on the side thereof which faces the opposing one of the leg members 54 and a pair of bevelled rollers 60, 62 which are journalled to each of the leg members 54 also on the side thereof which faces the opposing one of the leg members 54 but below, and respectively offset from, the cylindrical roller 58. The pair of bevelled rollers 60, 62 on each leg member 54 of the carriage 22 are vertically displaced below the cylindrical roller 58 through a distance slightly less than the thickness of the top plate 32 in order that the top plate 32 may be received between the bylindrical rollers 58 and the pairs of bevelled rollers 60, 62 with the cylindrical rollers 58 respectively engaging the upperside 46 of the top plate 32 near its longitudinal edges 38 and with each of the pairs of bevelled rollers 60, 62 at a continuous bevelled peripheral edge 64 on each roller 60, 62 engaging one of the tracking grooves 34 on the underside 36 of the top plate 32. By such mounting arrangement of the carriage 22 on the top plate 32 of the frame 30, the carriage 22 is only permitted to move along a linear path between the rearward and forward ends 40, 42, and parallel to the upperside 46, of the top plate 36.

An air cylinder 66 which is securedly mounted by an upstanding support brace 68 of the frame 30 may be appropriately actuated in a conventional manner to cause movement of the carriage 22 along its horizontal linear path via a linkage assembly 70 which couples the carriage body member 56 to a piston rod 72 which extends from the air cylinder 66. Accordingly, movement of the roller element 24 mounted by the carriage 22 is achieved through actuation of the air cylinder 66.

The carriage 22 further includes a U-shaped member 74 fixedly mounted on the carriage body member 56 which defines a vertically-directed channel 76 within which is slideably mounted a piston block 78 which is coupled at its upper end by another piston rod 80 to another air cylinder 82 securely mounted on the top end of the U-shaped member 74 by a bracket 84. Another bracket 86 slideably coupled to the lower end of the block 78 rotatably mounts the roller element 24. Selected actuation of the air cylinder 82 in a conventionally known manner will cause movement of the block 70 and thus the roller element 24 either toward or away from the top plate 32 as desired.

Reciprocatory movement of the roller element 24 in a transverse relationship to the linear path of movement of the carriage 22 and also to the longitudinal extent of the primary groove 16 and the wires W when positioned therein is caused by selective rotation of a head 88 on the end of the rotatable cable connected to a suitable drive means (not shown) which head 88 extends from the end of a cable sheath 90 mounted by a bearing/bracket assembly 92 to the U-shaped member 74. The rotatable cable head 88 is coupled to the slideable bracket 86 which mounts the roller element 24 via linkage arms 94, 96.

Figure 12:
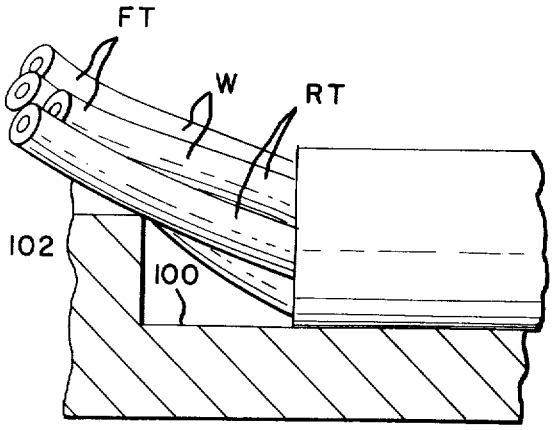
FIG. 12 is an enlarged fragmentary sectional view of the primary groove of the template of FIG. 3 taken along line 12—12 of FIG. 4 showing the trailing portions of the wires positioned therein.
Figure 13:
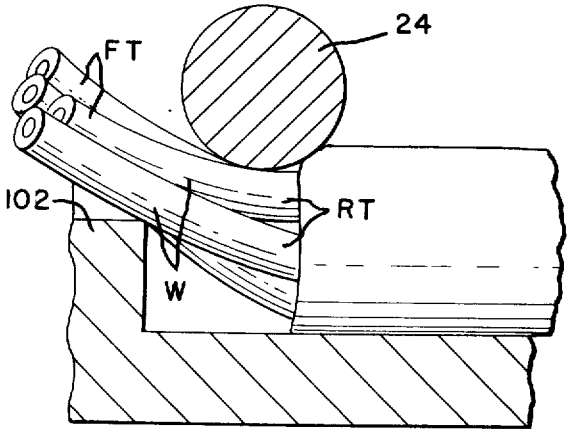
FIG. 13 is an enlarged fragmentary sectional view of the primary groove of the template of FIG. 3 taken along line 13—13 of FIG. 6 showing the roller element in cross-section engaged with the trailing portions.
Figure 14:
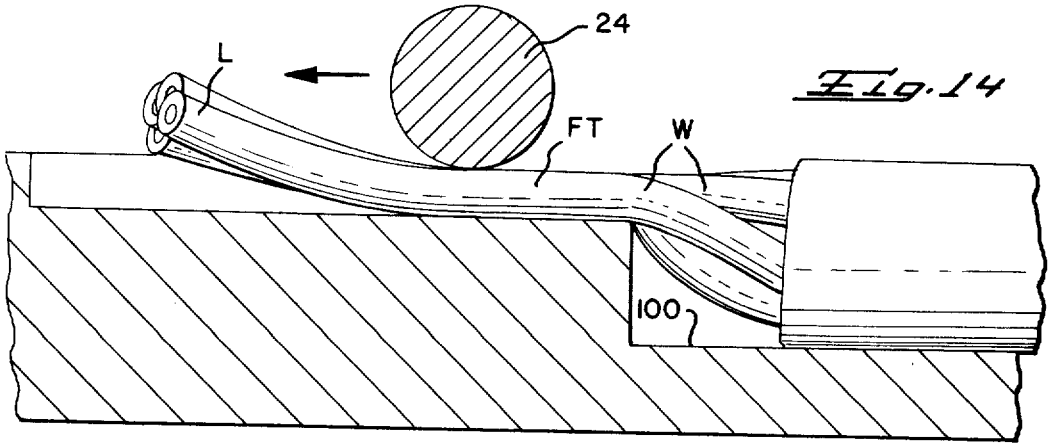
FIG. 14 is an enlarged fragmentary sectional view of the primary groove and the secondary grooves of the template of FIG. 3 taken along line 14—14 of FIG. 7 showing the roller element in cross-section engaged with the trailing portions and having forced the trailing portions into side-by-side dispositions with respect to each other in a shallower portion of the stepped primary groove.
Figure 18:
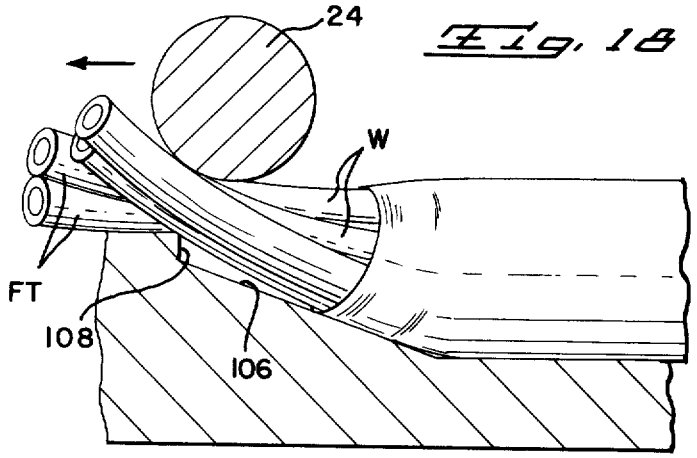
FIG. 18 is an enlarged fragmentary sectional view similar to that of FIG. 17 now showing further flattening of the insulation sheath on the ramp of the primary groove and spreading of the trailing portions of the wires on the step of the primary groove into side-by-side dispositions with respect to each other.
Figure 19:
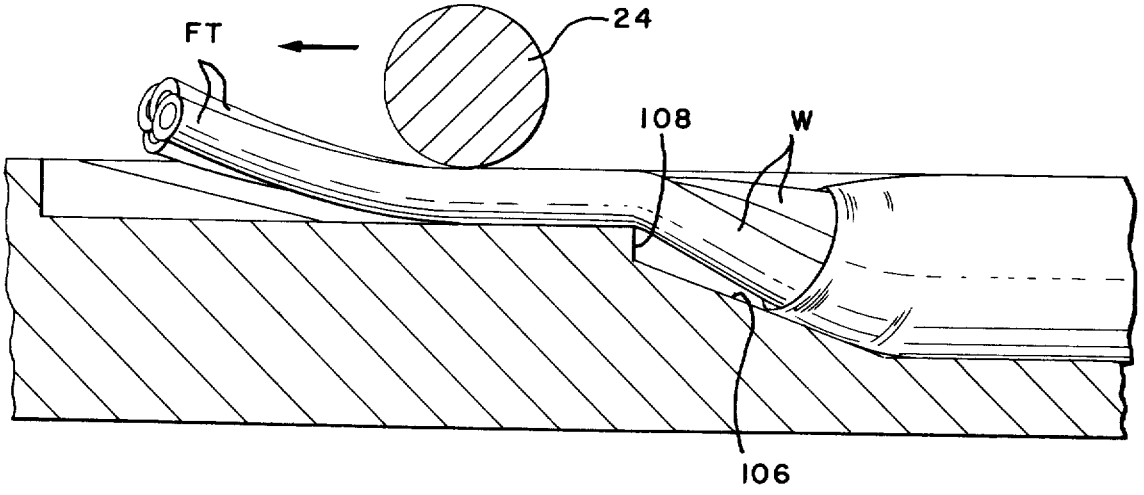
FIG. 19 is an enlarged fragmentary sectional view similar to that of FIG. 14 but showing the alternative form of the template of FIG. 15.

Referring now to FIGS. 3 through 8 and 11 through 14, in one form of the template 12 which may be utilized in the schematically illustrated sequence of operations carried out by the mechanisms 10, the primary groove 16 is defined by a recessed step, generally designated 98, formed in the planar surface 14 of the block of resilient material, such as steel, comprising the template 12. A rearward region of the primary groove 16 which is capable of substantially accommodating therein a rearward trailing portion RT of each of the wires W in a randomly bunched together condition, as illustrated in FIG. 12, comprises a lower tread 100 of the step 98. A forward region of the primary groove 16 which is capable of substantially accommodating therein a forward trailing portion FT of each of the wires arranged in a side-by-side bunched together condition, as illustrated in FIG. 14, comprises an upper tread 102 of the step 98. The lower and upper treads 100, 102 are interconnected by a riser 104.

Referring now to FIGS. 15 through 19, in another form of the template 12 which also may be utilized in the schematically illustrated sequence of operations carried out by the mechanism 10, the primary groove 16 has a ramp 106 and short riser 108 interconnecting the upper and lower treads 102, 100 of the step 98 instead of the longer riser 104.

Referring now to FIGS. 20 through 24, a preferred form of the template 12 is illustrated wherein a plunger element 110 is yieldably mounted by a suitable spring 112 in a forward end of the primary groove 16 contiguous to rearward ends of the secondary grooves 18. The plunger element 110 has an upper wire-confining notch 114 defined therein which forms a region capable of substantially accommodating the forward trailing portions FT of the wires W when arranged in a side-by-side bunched together condition, as illustrated in FIG. 23. Side nibs 116 which define the notch 114 are inclined toward the forward end of the template 16 and extend above the surface 14 of the template when the plunger element 110 is in its normal rest position. Further a forward lip 118 of the notch 114 is aligned above the rearward ends of the secondary grooves 18 when the plunger element 110 is in the normal rest position. When the roller element 24 is brought by the mechanism 10 into engagement with the plunger element 110 either by vertical descent of the block 78 or by forward movement of the carriage 22 where the roller element 24 was previously aligned for engagement with the top surface 14 of the template 12, the forward trailing portions FT of the wires W are forced by the compressive forces being introduced thereupon to become rearranged from their random bunched together condition of FIG. 22 to their side-by-side bunched together condition of FIG. 23. Further movement of the roller element 24 along the wires W, as caused by forward movement of the carriage 22 of the mechanism 10 along its linear path, engages the roller element 24 with the inclined surface of the nibs 116 and causes forced movement of the plunger element 110 against the action of the spring 112 to a depressed position, as shown in FIG. 24, in which the wire-confining notch 114 is now aligned with the rearward ends of the secondary grooves 18 and the leading portions L of the wires W are individually deposited into respective rearward ends of the secondary grooves.

Referring now to FIGS. 25 through 28, there is illustrated the reciprocatory movement of the roller element 24 which preferably occurs simultaneously as the roller element 24 is being brought into close proximity or actual engagement with the top surface 14 of the template 12 at the forward end of the primary groove 16. This transverse movement aids in the "rolling" of the wires W into side-by-side dispositions in order to insure and facilitate the subsequent forcing of individual leading portions L of the wires into respective secondary grooves 18.

What is claimed is:

1. A method of positioning leading portions of individual wires of a plurality of wires in spaced apart relationships with respect to each other, comprising the steps of:

providing first and second surfaces, said first surface having a primary groove capable of substantially accommodating therein a trailing portion of each of said wires in a bunched together condition and a plurality of secondary grooves which emanate from said primary groove along separate, spaced apart paths, each of said secondary grooves capable of substantially accommodating therein said leading portion of only one of said wires;

positioning said trailing portions of said wires in said bunched together condition in said primary groove of said first surface;

introducing an application of compressive forces on said wires at said trailing portions thereof by bringing said second surface and said primary groove of said first surface into close proximity to each other while said trailing portions are so positioned in said primary groove of said first surface; and continuing said application of said compressive forces simultaneously along said wires by moving at least one of said first and second surfaces relative to the other such that said application of said compressive forces simultaneously progresses along each of said wires from said trailing portion toward said leading portion of each of said wires whereby said leading portions of said wires are forced individually into respective secondary grooves and thereby positioned in spaced apart relationships with respect to each other.

2. A method as defined in claim 1 further comprising the step of:

moving at least one of said first and second surfaces relative to the other with the direction of movement being in a transverse relationship to the longitudinal extent of said trailing portions of said wires and said primary groove, simultaneously as said application of compressive forces is being introduced on said trailing portions, to thereby cause arrangement of said trailing portions of said wires in side-by-side dispositions with respect to each other within said primary groove and facilitate subsequent forcing of individual leading portions of said wires into respective secondary grooves by said continuation of said application of compressive forces simultaneously along said wires.

3. A method of positioning leading portions of individual wires of a plurality of wires in spaced apart relationships with respect to each other, comprising the steps of:

stationarily positioning a first surface having a primary groove capable of substantially accommodating therein a trailing portion of each of said wires in a bunched together condition and a plurality of secondary grooves which emanate from said primary groove along separate, spaced apart paths, each of said secondary grooves capable of substantially accommodating therein a leading portion of only one of said wires;

positioning said trailing portions of said wires in said bunched together condition in said first groove of said first surface;

bringing a second surface into closed proximity to said stationarily-positioned first surface such that said second surface overlies said primary groove and acts therewith to apply compressive forces on said trailing portions of said wires so positioned in said primary groove of said first surface; and continuing said application of said compressive forces simultaneously along said wires by moving said second surface relative to said first surface such that said application of said compressive forces simultaneously progresses along each of said wires from said trailing portion toward said leading portion of each of said wires whereby said leading portions of said wires are forced individually into respective secondary grooves and thereby positioned in spaced apart relationships with respect to each other.

4. A method as defined in claim 3 further comprising the step of:

moving said second surface relative to said stationarily-positioned first surface with the direction of movement being in a transverse relationship to the longitudinal extent of said trailing portions of said wires and said primary groove, simultaneously as said second surface is being brought into close proximity to said first surface, to thereby cause arrangement of said trailing portions of said wires in side-by-side dispositions with respect to each other within said primary groove and facilitate subsequent forcing of individual leading portions of said wires into respective secondary grooves by said continuation of said application of compressive forces simultaneously along said wires.

5. A method as defined in claim 4 wherein said moving of said second surface is carried out in a reciprocatory fashion relative to said first surface.

6. A method of positioning leading portions of individual detached flexible wires of a plurality of relatively movable wires in spaced apart relationships with respect to each other, comprising the steps of:

providing a template having a plurality of elongated grooves, each groove being capable of receiving only a single detached flexible wire, and one end of the grooves being in spaced apart relationships to each other;

holding portions of the plurality of wires in fixed relationship to each other adjacent the other end of the grooves; and positioning portions of the wires which extend away from the held portions of the wires in said plurality of grooves whereby portions of said positioned wires are disposed in spaced apart relationships with respect to each other.

7. A method of positioning portions of individual wires of a plurality of wires in spaced apart relationships with respect to each other, comprising the steps of:

providing a template having a plurality of spaced apart grooves, each groove being capable of receiving only a single wires;

holding portions of the wires in fixed relationship to each other adjacent one end of the grooves; and applying a compressive force to said portions of the wires over said one end of the grooves and moving the compressive force from one end of said grooves to the other end to progressively position said portions of the wires into said grooves whereby they are positioned in spaced apart relationships with respect to each other.

8. A method of positioning leading portions of individual wires of a plurality of wires in spaced apart relationships with respect to each other, comprising the steps of:

providing first and second surfaces, said first surface having a plurality of grooves, the terminal end portion of the grooves being in spaced apart relationshp with respect to each other, and each of said grooves being capable of substantially accommodating therein said leading portions of only one of said wires;

holding portions of said wires adjacent the other end of said plurality of grooves; and introducing an application of compressive force on said wires by bringing said second surface and said first surface into close proximity to each other while portions of the wires are being held adjacent said other end of said grooves and continuing the application of said compressive force simultaneously along the wires by moving at least one of said first and second surfaces relative to the other such that the application of the compressive force simultaneously progresses along each of said wires from the portion being held toward said leading portion of each of the wires whereby said leading portions of said wires are forced individually into respective grooves and are thereby positioned in spaced apart relationships with respect to each other.

9. A template for a wire separating mechanism being capable of positioning leading portions of individual wires of a plurality of wires in spaced apart relationships with respect to each other, said template comprising:

a block made of resilient material and having a generally planar top surface;

said surface having a primary groove defined therein, said primary groove capable of substantially accommodating therein a trailing portion of each of said wires in a bunched together condition and including a rearward region capable of substantially accommodating therein a rearward trailing portion of each of said wires in a randomly bunched together condition and a forward region having a shallower depth than that of said rearward region and capable of substantially accommodating therein a forward trailing portion of each of said wires arranged in a side-by-side bunched together condition; and said surface also having a plurality of secondary grooves defined therein which emanate from said forward region of said primary groove along separate, spaced apart paths, each of said secondary grooves capable of substantially accommodating therein said leading portion of only one of said wires.

10. A template as defined in claim 9 wherein:

said primary groove is defined by a recessed step formed in said surface of said block;

said rearward region of said primary groove is comprised by a lower thread of said step; and said forward region of said primary groove is comprised by an upper thread of said step.

11. A template for a wire separating mechanism being capable of positioning leading portions of individual wires of a plurality of wires in spaced apart relationships with respect to each other, said template comprising:

a block made of resilient material and having a generally planar top surface;

said surface having a primary groove defined therein, said primary groove capable of substantially accommodating therein a trailing portion of each of said wires in a randomly bunched together condition;

said surface also having a plurality of secondary grooves defined therein which emanate from said primary groove along separate, spaced apart paths, each of said secondary grooves capable of substantially accommodating therein said leading portion of only one of said wires; and a plunger element yieldably mounted in a forward end of said primary groove contiguous to rearward ends of said plurality of secondary grooves and having an upper wire-confining region capable of substantially accommodating therein a forward trailing portion of each of said wires when arranged in a side-by-side bunched together condition, said plunger element capable of being forced to move toward into said primary groove from a normal rest position in which said upper wire-confining region of said plunger element is displaced above said rearward ends of said secondary grooves to a depressed position in which said wire-confining region is aligned with said rearward ends of said secondary grooves, whereby when said forward trailing portions of said wires are arranged in said side-by-side bunched together condition within said upper wire-confining region of said plunger element with said element being in its normal rest position, forced movement of said plunger element to its depressed position results in leading portions of said wires adjacent to said forward trailing portions thereof being individually deposited into respective rearward ends of said secondary grooves.

* * * * *